US005277214A

United States Patent [19]

Tolley

[11] Patent Number: 5,277,214

[45] Date of Patent: Jan. 11, 1994

[54] TIRE CHANGING TENT APPARATUS

[76] Inventor: William J. Tolley, 103 Sammy's Rd., Covington, Va. 24426

[21] Appl. No.: 58,137

[22] Filed: May 10, 1993

[51] Int. Cl.[5] ..... E04H 15/48

[52] U.S. Cl. ..... 135/109; 135/115; 135/117; 135/120

[58] Field of Search ..... 135/88, 106, 109, 115, 135/117, 120

[56] References Cited

U.S. PATENT DOCUMENTS

| | | | |
|---|---|---|---|
| 2,598,940 | 6/1952 | Robie | 135/88 X |
| 2,829,659 | 4/1958 | Megenity | 135/109 X |
| 3,746,386 | 7/1973 | Woodward | 135/115 X |
| 4,072,158 | 2/1978 | O'Brien et al. | 135/117 X |
| 4,144,899 | 3/1979 | Kays | 135/115 X |
| 4,265,261 | 5/1981 | Barker | 135/117 X |
| 4,343,322 | 8/1982 | Fiddler | 135/109 X |
| 4,685,484 | 8/1987 | Moneta | 135/117 |
| 4,748,995 | 6/1988 | Viglione | 135/109 |
| 4,886,083 | 12/1989 | Gamache | 135/109 X |

*Primary Examiner*—Carl D. Friedman
*Assistant Examiner*—Lan M. Mai
*Attorney, Agent, or Firm*—Leon Gilden

[57] ABSTRACT

A tent structure arranged to afford protection to an individual during a tire changing procedure, wherein the tent structure includes a U-shaped base rib, with a plurality of intermediate ribs and a leading rib, with each of the ribs pivotally mounted relative to a central axle, with web members extending between the ribs to afford protection to an individual positioned within the tent structure. The tent organization includes magnet members mounted to the leading rib for magnetic adherence to a body panel of an associated vehicle to enhance positioning of the tent structure relative to the vehicle.

6 Claims, 4 Drawing Sheets

TIRE CHANGING TENT APPARATUS

BACKGROUND OF THE INVENTION

1. Field of the Invention

The Field of Invention relates to tent apparatus, and more particularly pertains to a new and improved tire changing tent apparatus wherein the same is directed for positioning and securement relative to an automotive vehicle for affording protection to an individual during a tire changing procedure.

2. Description of the Prior Art

Tent structure of various types are available in the prior art and exemplified by U.S. Pat. Nos. 4,993,773; 3,875,953; 3,707,977; and 3,894,765.

The instant invention attempts to overcome deficiencies of the prior art by providing for a tent structure easily and readily extended for positioning adjacent to a body panel of a vehicle to afford protection to an individual during a tire changing procedure and in this respect, the present invention substantially fulfills this need.

SUMMARY OF THE INVENTION

In view of the foregoing disadvantages inherent in the known types of tent apparatus now present in the prior art, the present invention provides a tire changing tent apparatus wherein a plurality of pivotally mounted U-shaped ribs mount fabric webs therebetween accommodating securement to a side panel of an associated automotive vehicle. As such, the general purpose of the present invention, which will be described subsequently in greater detail, is to provide a new and improved tire changing tent apparatus which has all the advantages of the prior art tent apparatus and none of the disadvantages.

To attain this, the present invention provides a tent structure arranged to afford protection to an individual during a tire changing procedure, wherein the tent structure includes a U-shaped base rib, with a plurality of intermediate ribs and a leading rib, with each of the ribs pivotally mounted relative to a central axle, with web members extending between the ribs to afford protection to an individual positioned within the tent structure. The tent organization includes magnet members mounted to the leading rib for magnetic adherence to a body panel of an associated vehicle to enhance positioning of the tent structure relative to the vehicle.

My invention resides not in any one of the these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved tire changing tent apparatus which has all the advantages of the prior art tent apparatus and none of the disadvantages.

It is another object of the present invention to provide a new and improved tire changing tent apparatus which may be easily and efficiently manufactured and marketed.

It is a further object of the present invention to provide a new and improved tire changing tent apparatus which is of a durable and reliable construction.

An even further object of the present invention is to provide a new and improved tire changing tent apparatus which is susceptible of a low cost of manufacture with regard to both materials and labor, and which accordingly is then susceptible of low prices of sale to the consuming public, thereby making such tire changing tent apparatus economically available to the buying public.

Still yet another object of the present invention is to provide a new and improved tire changing tent apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
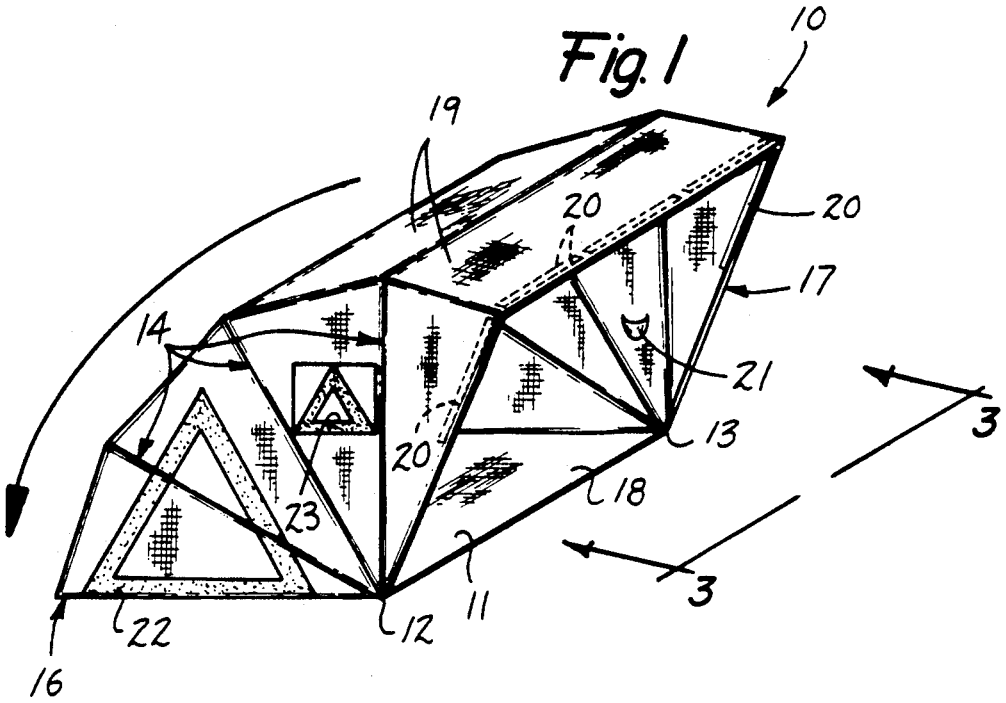
FIG. 1 is an isometric illustration of the invention.
Figure 2:
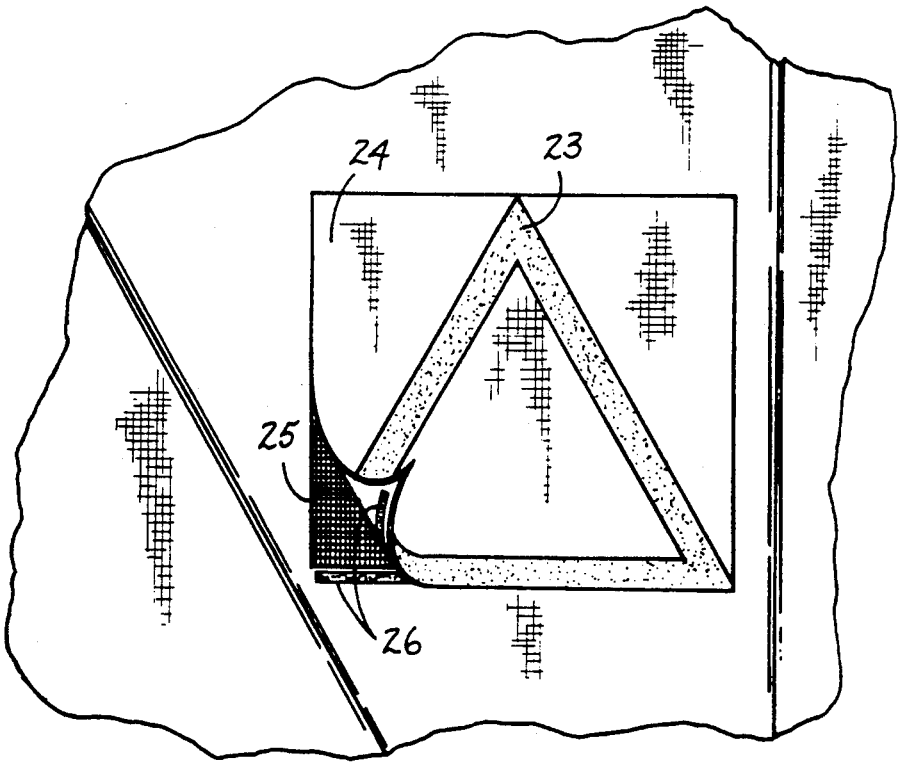
FIG. 2 is an enlarged orthographic view of a window structure employed by the invention.

With reference now to the drawings, and in particular to FIGS. 1 to 8 thereof, a new improved tire changing tent apparatus embodying the principles and concepts of the present invention and generally designated by the reference numeral 10 will be described.

More specifically, the tire changing tent apparatus 10 of the instant invention essentially comprises a central axle 11, having an axle first end 12 spaced from an axle second end 13. A semi-annular array of intermediate U-shaped ribs 14 are pivotally mounted about the axle first and second ends 12 and 13, with a U-shaped base rib 16 mounted to the axle 11 at the first and second ends 12 and 13 exteriorly of the intermediate ribs, with a U-shaped leading rib 17 mounted to the axle first and second ends 12 and 13 exteriorly of the intermediate ribs. Intermediate webs 19 are provided extending between the intermediate ribs, as well as one of the intermediate webs 19 extending between the base rib 16 and one of the U-shaped ribs, with a further of the intermediate webs 19 extending between a further of the intermediate ribs and the leading rib 17. A base web 18 extends within the base rib 16 coextensively thereof, as illustrated in FIG. 1 for example. A plurality of ferrous metallic members 20 are mounted to the leading rib 17, with at least one of the magnetic members 20 parallel to the axle 11 for adherence to a panel of an associated automotive vehicle (not shown). A pocket member 21 is mounted to one of the intermediate webs 19 in adjacency to the axle 18 for securing lug nuts and the like removed during a tire changing procedure. At least one reflector panel 22 is mounted to the tent apparatus extending over at least one of the panels 19, with a second reflector panel 23 mounted to a support web 24, with the support web 24 having cooperative hook and loop fastener portions 26 securing the web portion to the adjacent panel 19. It is further contemplated that the reflector panel be imparted upon the screen structure 25 upon removal of the support web 24 relative to the screen 25.

Figure 3:
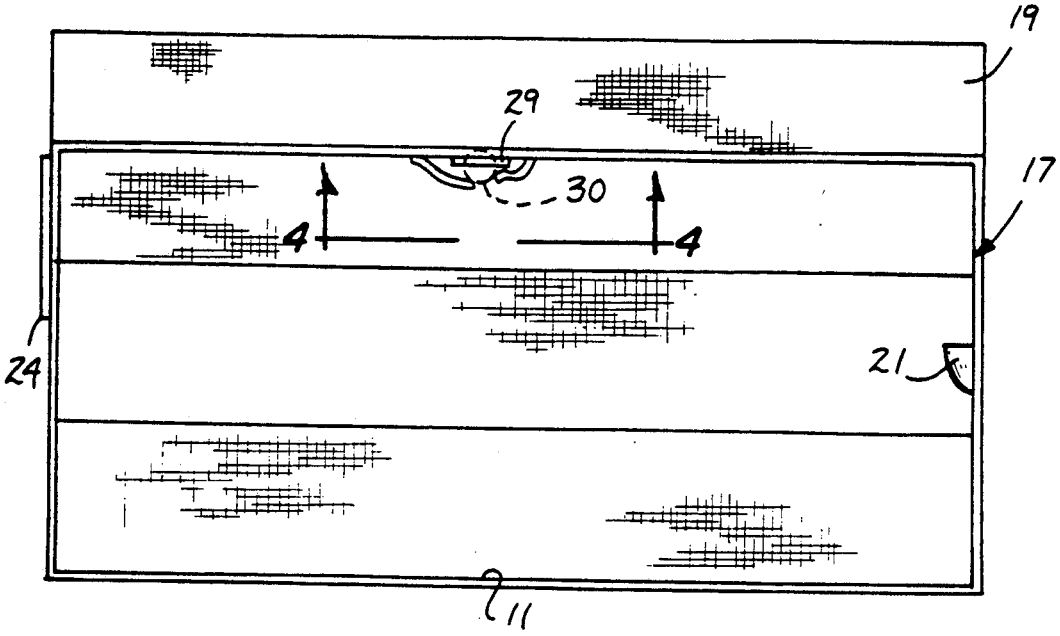
FIG. 3 is an orthographic view, taken along the lines 3—3 od FIG. 1 in the direction indicated by the arrows.
Figure 4:
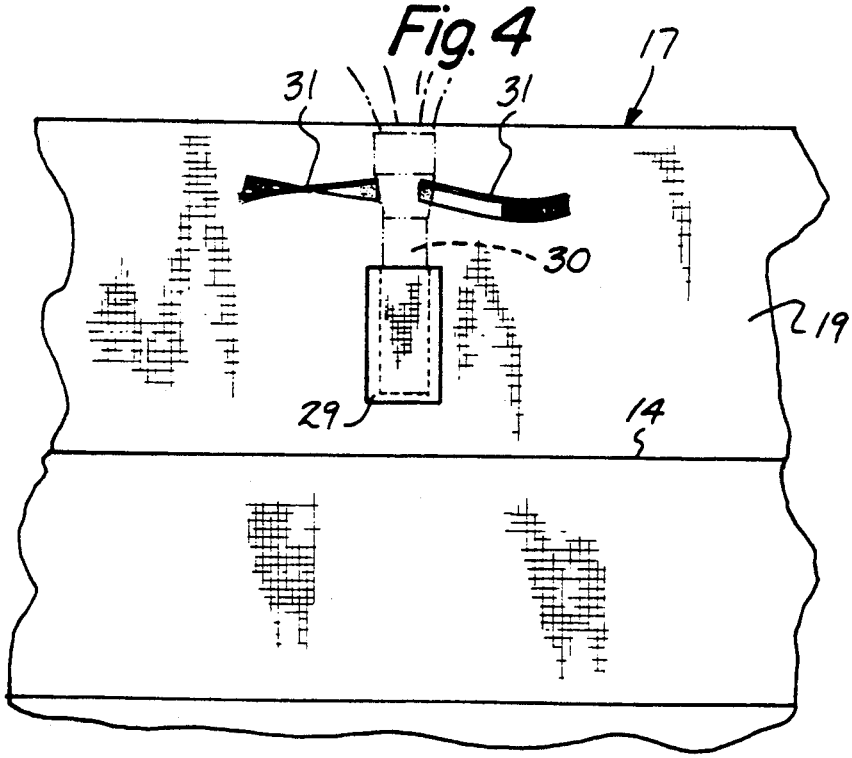
FIG. 4 is an orthographic view, taken along the lines 4—4 of FIG. 3 in the direction indicated by the arrows.
Figure 5:
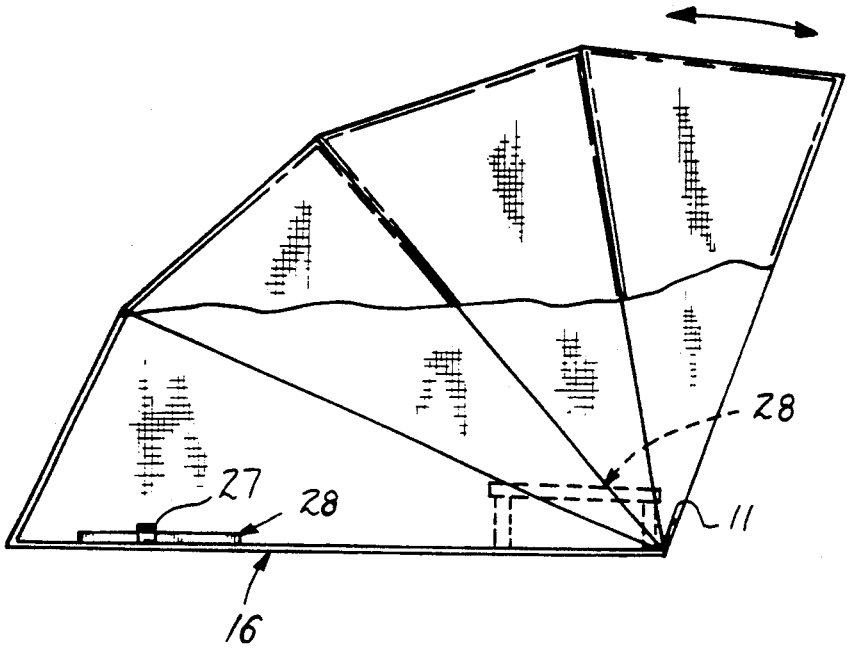
FIG. 5 is an orthographic side view, partially in section, of the tent structure.
Figure 6:
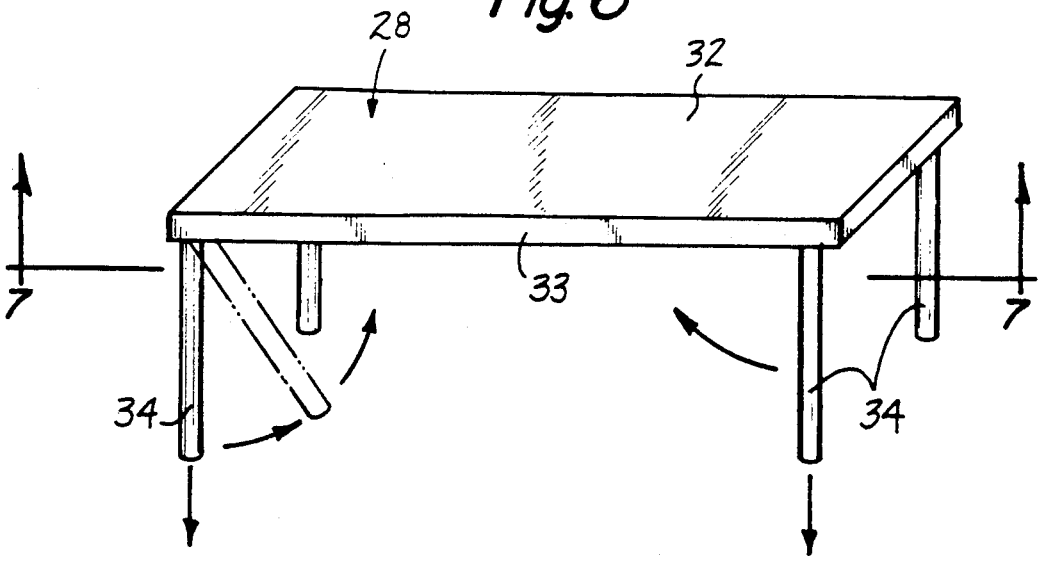
FIG. 6 is an isometric illustration of a table structure employed by the tent structure.

The FIG. 3 indicates the use of a flashlight pocket 29 mounted to a panel member 19 intermediate of the leading rib 17, with a flashlight 30 received within the pocket and secured relative to the pocket by a plurality of flashlight securement straps 31 oriented between the pocket 29 and the leading rib 17 mounted to a panel member 19 between the leading rib and an intermediate rib 14.

Figure 7:
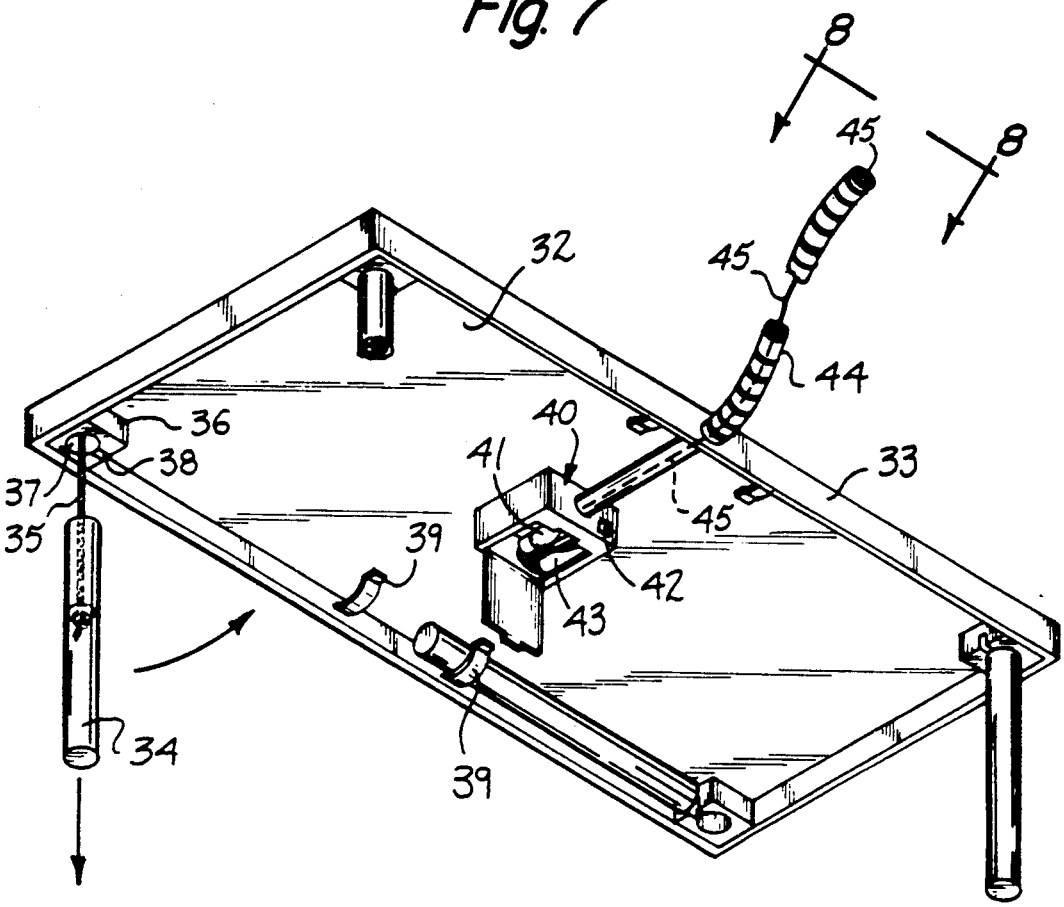
FIG. 7 is an enlarged isometric bottom view of the table structure.

A table assembly 28 is arranged for storage and mounting to the base web 18 employing mounting strap structure 27 that may be formed of any convenient construction such as elastomeric, belt and buckle structure, and the like. The table plate 32 is arranged for removal from the mounting strap structure 27 for erecting the table in adjacency to the axle 11 providing for convenient seating for an individual during a tire changing procedure. A table plate 32 having a table skirt 33 includes a plurality of table legs 34. Each of the table legs 34 includes an elastomeric cord 35 securing a respective table leg to the table plate 32 within the skirt 33, in a manner as indicated in FIG. 7. A support boss 36 is provided in surrounding relationship relative to each elastomeric cord 35, with the support boss 36 having a support boss cavity 37 to complementarily receive the table leg 34 in an orthogonal orientation relative to the table plate 32. The support boss cavity 37 includes a slot 38 in communication with the cavity 37 extending in a facing relationship relative to one of a plurality of spring clips 39, such that each spring clip 39 receives an individual table leg 34 when the elastomeric cord 35 is directed through the slot 38 permitting positioning of the table leg 34 within the spring clip.

Figure 8:
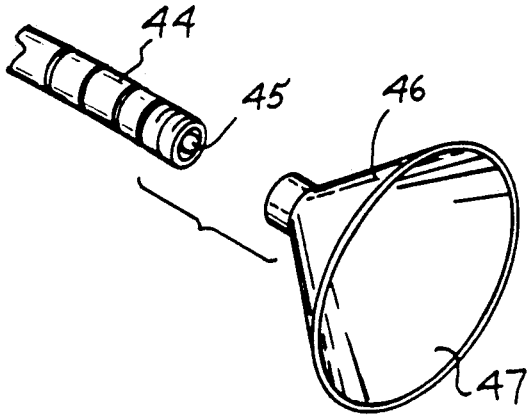
FIG. 8 is an isometric illustration, taken along the lines 8—8 of FIG. 7 in the direction indicated by the arrows.

The FIGS. 7 and 8 further indicates the use of an illumination housing 40, having an illumination bulb 41 operative through a switch 42 and a battery 43 to direct illumination through a goose neck filler tube 44 projecting exteriorly of the table skirt 33, having a fiber optic cable 45 directed through the goose neck, with a first end of the fiber optic cable 45 positioned in adjacency relative to the illumination bulb, with a second end positioned at a free end of the flexible tube 44, as illustrated in FIG. 8, wherein a diffuser shield 46 mounted to the free end of the goose neck tube 44 includes a reflective conical interior wall 47 to enhance illumination directed onto a tire structure during a tire changing procedure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A tire changing tent apparatus, comprising, a central axle, the central axle having an axle first end spaced from an axle second end, and a semi-annular array of rib members, including intermediate U-shaped ribs mounted to the axle first end and to the axle second end, with a U-shaped base rib mounted to the axle first end and the axle second end in adjacency to one of said intermediate U-shaped ribs, and a U-shaped leading rib spaced from the intermediate ribs and the base rib, with the leading rib mounted to the axle first end and the axle second end, with a plurality of intermediate webs mounted between the intermediate ribs coextensively therewith, with a further of the intermediate webs mounted between the base rib and one of said intermediate ribs, and a further of said intermediate webs mounted to a further of said intermediate ribs and to the leading rib, and a base web mounted coextensively within the base rib, and a plurality of ferrous metallic magnetic members mounted to the leading rib, with at least one of said magnetic members mounted in a parallel relationship relative to the axle.

2. An apparatus as set forth in claim 1 including a mounting strap mounted to the base web, with a table assembly arranged for securement between the mounting strap and the base web, with the table assembly arranged for removal relative to the mounting strap.

3. An apparatus as set forth in claim 2 including a flashlight pocket mounted to the further of said intermediate webs in adjacency to the leading rib, with a flashlight arranged for reception within the flashlight pocket, and a securement strap means mounted to the further intermediate web between the flashlight pocket and the leading rib for securement and orientation of the flashlight.

4. An apparatus as set forth in claim 3 wherein the table assembly includes a table skirt and a plurality of table legs, with table leg having an elastomeric cord extending from the at least one table leg to the table plate, and a support boss arranged in surrounding relationship relative to the elastomeric cord within, with each support boss mounted to the table plate in adjacency to the table skirt, the support boss including a support boss cavity arranged for receiving one of said table legs, and the support boss cavity having a slot, with a plurality of spring clips mounted to the table plate within the skirt, and at least one spring clip mounted adjacent said support boss in facing relationship relative to said slot to secure the table leg in a stored orientation within the table skirt.

5. An apparatus as set forth in claim 4 including an illumination housing mounted to the table plate, the illumination housing including an illumination bulb, and a battery and a switch member arranged for effecting actuation of the illumination bulb, with a goose neck flexible tube extending from the illumination housing through the table skirt, with a fiber optic cable directed through the flexible tube, with a first end of the fiber optic cable positioned in adjacency to the illumination bulb, and a second end of the fiber optic cable positioned within a free end of the tube.

6. An apparatus as set forth in claim 5 including a diffuser shield mounted to the free end of said tube, with the diffuser shield including an interior wall, the interior wall formed of a reflective material to enhance reflection of illumination from the fiber optic cable.

* * * * *